United States Patent [19]

Nedstedt

[11] Patent Number: 4,620,184

[45] Date of Patent: Oct. 28, 1986

[54] SENSING ARRANGEMENT ON A MATERIAL ROLL

[75] Inventor: Ulf Nedstedt, Eslöv, Sweden

[73] Assignee: Tetra Pak International AB, Lund, Sweden

[21] Appl. No.: 702,734

[22] Filed: Feb. 19, 1985

[30] Foreign Application Priority Data

Mar. 7, 1984 [SE] Sweden ..... 8401246

[51] Int. Cl.[4] ..... G08B 21/00

[52] U.S. Cl. ..... 340/675; 200/61.16; 226/11; 335/205

[58] Field of Search ..... 340/675; 200/61.16; 335/205; 226/11; 242/57

[56] References Cited

U.S. PATENT DOCUMENTS 3,081,958 3/1963 Kegg ..... 200/61.16
4,204,180 5/1980 Usui et al. ..... 335/205
4,401,865 8/1983 Benoy ..... 200/61.16
4,422,402 12/1983 Ogihara ..... 340/675

*Primary Examiner*—Glen R. Swann, III
*Attorney, Agent, or Firm*—Burns, Doane, Swecker & Mathis

[57] ABSTRACT

Sensing arrangements on material rolls are used to give advance warning when the material web forming the roll approaches its end. Usually this involves the sensing of the reduction of the the roll diameter with the help of a sensing device resting against the roll periphery. In the case of roll suspensions where the center of the roll is not fixed, these sensing arrangements cannot be used. The present invention uses a sensing arrangement which comprises a field-generating element, e.g. a permanent magnet, present in the center of the roll, together with a movable sensing device resting against the periphery of the roll, e.g. a heavy current switch which is acted upon at a certain predetermined field strength, and in a suitable manner indicates that a roll replacement is imminent.

9 Claims, 2 Drawing Figures

SENSING ARRANGEMENT ON A MATERIAL ROLL

BACKGROUND AND SUMMARY OF THE INVENTION

The present invention relates to an arrangement for the sensing of the material thickness on a roll of weblike material.

Weblike material is used very widely in various branches of industry. In the technique of packaging, for example, flexible weblike material is used as a starting material in the manufacture of packages, packing containers or the like. The conversion of the weblike material to finished packages takes place in packing machines which have a magazine to accommodate the web-like material in rolled-up condition. During operation of the machines the roll of weblike material is successively used up and has to be replaced, therefore, at regular intervals. To assist the machine operator, as he occasionally may have to handle several machines, the packing machines are generally provided with some form of indicating arrangement which visually or acoustically gives a signal when a roll diameter has been reduced to such an extent that roll replacement is imminent.

Known arrangements for the sensing of the material thickness on a roll of weblike material are usually either of the mechanical or of the optical type. The mechanical arrangements generally make use of an arm resting against the roll periphery which as it approaches the roll centre, as the material is being used up or depleted, acts upon a limit switch to transmit an electric signal to an indicating arrangement. The optical type operates with a photocell which is located on one side of the material roll and which, after a certain consumption of material, is struck by a light beam from a light source situated on the opposite side of the roll. At this the photocell transmits a signal to an indicating arrangement of the known type.

Both these known arrangements have proved to function well and provide a relatively reliable indication, so that the web splicing and the roll replacement can be done in good time and without the loss of an excessive quantity of residual material on the roll. The satisfactory operation fully depends, however, on the roll centre being in a fixed position in relation to the sensing element during the whole time of the material consumption. This condition can be achieved only if, in the first place, the axle which supports the material roll is rotatable in fixed bearing points on the frame of the machine and, in the second place, the outside diameter of the axle (possibly with intermediate elements, e.g. flanges or the like) corresponds to the inside diameter in the bobbin upon which the material is rolled up. The design and function of the sensing arrangement thus make demands on the suspension of the material roll which, otherwise, are not required, and it would be desirable, therefore, to provide a sensing arrangement which could operate with sufficient accuracy even on loosely suspended, radially movable material rolls.

It is an object of the present invention to provide an arrangement for the sensing of the material thickness on a roll of weblike material, with the arrangement not subject to the disadvantages of earlier, similar arrangements. The present invention allowing a reading of the material thickness on a roll even if it is moved in an irregular manner in a radial direction during the consumption of material.

It is a further object of the present invention to provide a sensing arrangement of the aforementioned type which is simple to manufacture and inexpensive and which gives such accuracy that the material wastage can be minimized.

These and other objects have been achieved in accordance with the invention in that an arrangement of the type described provides a movable sensing device resting against the periphery of the roll and adapted so that at a predetermined distance from the centre of the roll it is acted upon by a field-generating element located in the central part of the roll.

Owing to the sensing device present on the periphery of the roll being adapted to be acted on at a certain distance from the centre of the roll by a field-generating element present in the central part of the roll, the residual material thickness between the sensing device and field-generating element only will be registered. Any movements in the roll in radial direction will not affect the sensing device, since movements of the roll with respect to the point of suspension of the material roll have no consequence. Thus the material roll can be suspended in a very simple and labor-saving manner, e.g., an under-dimensioned axle is stuck through the bobbin of the roll and subsequently is placed freely movable between two V-shaped bearing elements.

A preferred embodiment of the arrangement in accordance with the invention will now be described in detail with special reference to the enclosed schematic drawing which only shows the parts indispensable for the understanding of the invention.

DETAILED DESCRIPTION OF THE PREFERRED EMBODIMENT

Figure 1:
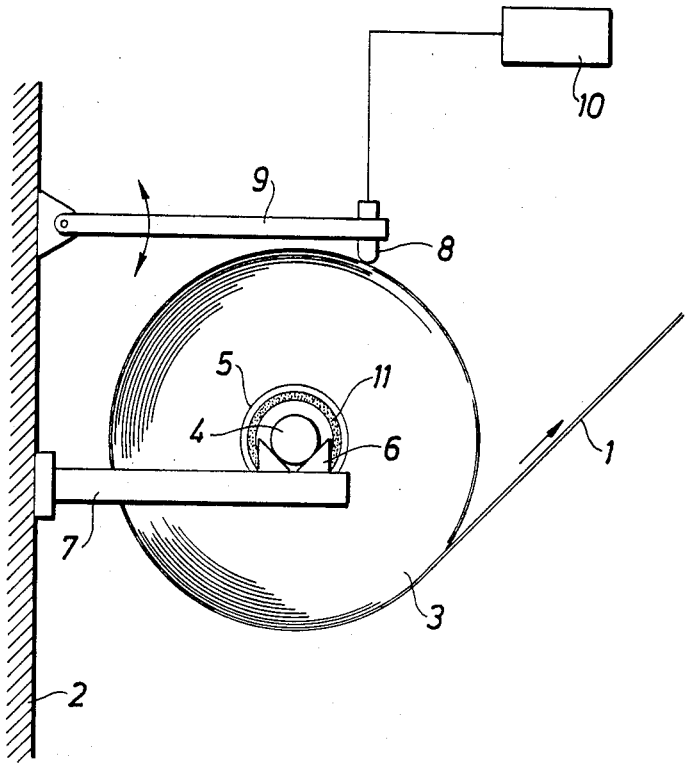
FIG. 1 shows a side view of an arrangement in accordance with the invention for use of in a packing machine of a known type.

In a machine for the manufacture of packages, weblike material 1 is rolled off from a material roll 3 which is supported so that it can freely rotate in the frame 2 of the machine. The material roll 3 is supported by an axle 4 which extends through the bobbin 5 of the roll and is supported in V-shaped recesses 6 on either side of the roll 3. The V-shaped recesses are arranged in beams 7 which are firmly joined to the frame of the machine.

The sensing arrangement in accordance with the invention comprises a movable sensing device 8 which is joined to the machine frame 2 by means of a vertically pivotable arm 9. The sensing device 8 is connected electrically to a unit 10 which e.g. may be a unit for automatic web splicing or a visual or acoustic indicating arrangement.

Figure 2:
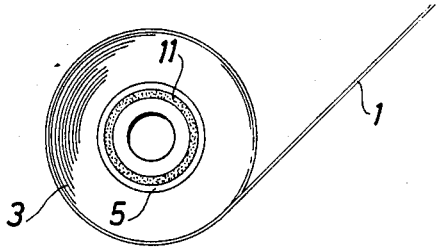
FIG. 2 shows a central part of a material roll.

In the central part of the material roll, that is to say in the bobbin 5, a field-generating element 11 is located which, for example, may be connected directly to the inside of the bobbin 5 or may be supported by a mounting device located in the roll center which, for example, is expandable or is adapted to be fixed centrally in the bobbin 5 by means of spring force. As shown in FIGS. 1 and 2, the element 11 is concentric with the bobbin 5.

The sensing device 8 and the field-generating element 11 co-operate in such a manner that the sensing device is acted upon by the field generated by element 11 when it is at a certain distance from the field-generating element 11. This distance is adjustable e.g. by regulating the field strength of the generating element or the sensitivity of the sensing device. The field-generating element 11 is preferably a magnet, for example a permanent magnet, which generates a magnetic field acting upon the sensing device. The sensing device may be a heavy current switch which can be acted upon magnetically and which, at a certain field strength, closes the circuit and thus acts on the unit 10 so that the unit 10 transmits a visual or acoustic indication or starts an automatic web splicing procedure, set up earlier.

During operation of the arrangement in accordance with the invention, the material web 1 is consumed successively by the machine and the diameter of the roll 3 diminishes. As this happens the sensing device 8 resting against the periphery of the roll, due to the force of gravity (or possibly with the help of a spring, not shown), will approach the centre of the roll and the field-generating element 11 located there. As soon as the field strength is sufficiently great for the sensing device to be acted upon, the circuit to the unit 10 is closed which in turn influences the indicating arrangement or starts the web splicing. In practical experiments it has been found that the arrangement can be adjusted with great accuracy, and it is possible, for example with a material web thickness of approx. 0.4 mm to obtain an indication when only two turns of material remain on the roll which in a typical packing machine means that only approx. 6 packages remain unused on the roll when the splicing is carried out.

Although a permanent magnet (e.g. of the self-holding band type) and a heavy current switch have proved very suitable in practical experiments, it is possible, of course, also to use other types of field-generating elements and sensing devices. Thus, for example, the field-generating element may be constituted of a radioactive isotope which with the help of a sensing device, sensitive to radioactive emission, may be used to give an indication when an appropriate quantity of material remains on the roll. Both these types of sensing arrangements have the advantage (in contrast to e.g. inductive-type transducers) that they operate also if, for example, a metal foil is included in the material web for which the arrangement is intended, which, in many cases is essential as e.g. aluminium foils are frequently included in the packing laminate.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. An arrangement for sensing thickness of a roll of weblike material, comprising a movable sensing device positioned against a peripheral section of the roll so that at a predetermined distance from the roll center, the sensing device is acted upon by a field-generating element positioned in a central part of the roll.

2. An arrangement in accordance with claim 1, wherein the field-generating element generates a magnetic field.

3. An arrangement in accordance with claim 2, wherein the field-generating element is a permanent magnet.

4. An arrangement in accordance with claim 1, wherein the sensing device is a magnetically actuated heavy current switch.

5. An arrangement in accordance with claim 1, wherein the field-generating element is connected to a bobbin located in the central part of the roll.

6. An arrangement in accordance with claim 1, wherein the field-generating element is supported by a mounting device located in the central part of the roll.

7. An arrangement in accordance with claim 1, wherein the sensing device is connected electrically to a visual indicating device.

8. An arrangement in accordance with claim 1, wherein the sensing device is connected electrically to means for automatic web splicing.

9. An arrangement in accordance with claim 1, wherein the sensing device is electrically connected to an acoustic indicating device.

* * * * *